US009618891B1

(12) United States Patent
Fahmy et al.

(10) Patent No.: US 9,618,891 B1
(45) Date of Patent: Apr. 11, 2017

(54) BI-DIRECTIONAL SPRING BRAKE FOR A PHOTODUCTIVE DRUM

(71) Applicant: LEXMARK INTERNATIONAL, INC., Lexington, KY (US)

(72) Inventors: Alfred Louis Fahmy, Lexington, KY (US); James Eric Dickerson, Lexington, KY (US); Kyle Benjamin Freels, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/923,980

(22) Filed: Oct. 27, 2015

(51) Int. Cl.
*G03G 15/00* (2006.01)

(52) U.S. Cl.
CPC ..... *G03G 15/5008* (2013.01)

(58) Field of Classification Search
CPC ..... G03G 15/50; G03G 15/5008
USPC ..... 399/167
See application file for complete search history.

(56) References Cited

U.S. PATENT DOCUMENTS 6,009,291 A * 12/1999 Curry ..... G03G 15/0872 399/167
2005/0163531 A1* 7/2005 Kuroda ..... G03G 15/757 399/116
2013/0008392 A1* 1/2013 Holmstrom ..... A01K 27/004 119/796
2015/0030353 A1* 1/2015 Wang ..... F16D 3/06 399/167

* cited by examiner

*Primary Examiner* — Walter L Lindsay, Jr.
*Assistant Examiner* — Jessica L Eley
(74) *Attorney, Agent, or Firm* — Justin M. Tromp

(57) ABSTRACT

A photoconductive drum assembly according to one embodiment includes a photoconductive drum rotatable about a rotational axis in first and second rotational directions. A spring brake has a coiled portion wrapped around a portion of the photoconductive drum at its axial end and around the rotational axis of the photoconductive drum. The spring brake has a first arm and a second arm. The first arm is positioned to flex in an unwinding direction causing the coiled portion to unwind upon the first arm receiving a force in the first rotational direction. The first arm is positioned to flex in a winding direction and to push the second arm in an unwinding direction relieving winding of the coiled portion caused by the flexing of the first arm in the winding direction of the first arm upon the first arm receiving a force in the second rotational direction.

12 Claims, 4 Drawing Sheets

BI-DIRECTIONAL SPRING BRAKE FOR A PHOTODUCTIVE DRUM

CROSS REFERENCES TO RELATED APPLICATIONS

None.

BACKGROUND

1. Field of the Disclosure

The present disclosure relates generally to electrophotographic image forming devices and more particularly to a bi-directional spring brake for a photoconductive drum of an electrophotographic image forming device.

2. Description of the Related Art

As is well known in the art, during a print operation by an electrophotographic image forming device a charge roll charges the surface of a photoconductive drum to a predetermined voltage. The charged surface of the photoconductive drum is then selectively exposed to a laser light source to selectively discharge the surface of the photoconductive drum and form an electrostatic latent image on the photoconductive drurnm corresponding to the image being printed. Toner is picked up by the latent image on the photoconductive drum from a developer roll creating a toned image on the surface of the photoconductive drum. The toned image is then transferred from the photoconductive drum to the print media either directly by the photoconductive drum or indirectly by an intermediate transfer member. A cleaning blade or roller removes any residual toner adhering to the photoconductive drum after the toner is transferred from the photoconductive drum. The cleaned surface of the photoconductive drum is then ready to be charged again and exposed to the laser light source to continue the printing cycle.

The photoconductive drum may include a spring brake that applies a uniform drag on the photoconductive drum when the photoconductive drum rotates in an operative rotational direction in order to minimize jitter and backlash of the photoconductive drum. FIG. 1 shows a prior art photoconductive drum 20. Photoconductive drum 20 includes a hollow cylindrical drum member 22 having an outer surface 24. Drum member 22 is mounted on a shaft 26 that defines a rotational axis 28 of photoconductive drum 20. An end cap 30 is positioned on an axial end 32 of drum member 22. End cap 30 includes a circular hub 34 on an outboard side of end cap 30. Hub 34 has an opening 36 that is centered around rotational axis 28. Shaft 26 is attached to end cap 30 and passes through opening 36 such that shaft 26, end cap 30 and drum member 22 rotate in unison.

With reference to FIGS. 1 and 2, photoconductive drum 20 includes a spring brake 40 mounted on end cap 30. Spring brake 40 includes a segment of spring wire 41 that forms a coiled portion 42 and a pair of arms 44, 46. Coiled portion 42 includes a middle portion of spring wire 41 coiled around a center axis 43. Arms 44, 46 are formed by respective ends of spring wire 41. Coiled portion 42 is wrapped around hub 34 of end cap 30. Arm 44 extends beyond an outer circumference of end cap 30 and is positioned to contact a stop 48 (shown schematically) when photoconductive drum 20 rotates in an operative rotational direction indicated by arrow A in FIG. 1. When photoconductive drum 20 rotates in the operative rotational direction, spring brake 40 rotates with end cap 30 until arm 44 contacts stop 48, which stops the rotation of spring brake 40 with photoconductive drum 20. When arm 44 contacts stop 48, the force on arm 44 from stop 48 causes arm 44 to flex counter to the operative rotational direction of photoconductive drum 20 which, in turn, causes coiled portion 42 to unwind slightly from hub 34. Coiled portion 42 remains in contact with hub 34 but allows photoconductive drum 20 to continue rotating with coiled portion 42 applying a uniform drag on photoconductive drum 20. Arm 46 is spaced clear of arm 44 and provides no functionality other than forming an end of spring brake 40.

SUMMARY

A spring brake for use with a photoconductive drum of an electrophotographic image forming device according to one example embodiment includes a spring wire having a coiled portion and first and second arms extending from the coiled portion. The coiled portion is coiled around a center axis. Each of the first arm and the second arm has a winding direction around the center axis and an unwinding direction around the center axis. A force on the first arm in the winding direction of the first arm causes the coiled portion to wind and a force on the first arm in the unwinding direction of the first arm causes the coiled portion to unwind. A force on the second am in the winding direction of the second armn causes the coiled portion to wind and a force on the second arm in the unwinding direction of the second arm causes the coiled portion to unwind. In home positions of the first arm and the second arm, a portion of the second arm is positioned in close proximity to the first arm such that flexing of the first arm friom the home position of the first arm in the winding direction of the first arm causes the first arm to push the second arm from the home position of the second arm in the unwinding direction of the second arm relieving winding of the coiled portion caused by the flexing of the first arm in the winding direction of the first arm.

A photoconductive drum assembly for use in an electrophotographic image forming device according to one example embodiment includes a photoconductive drum rotatable about a rotational axis in a first rotational direction and a second rotational direction opposite the first rotational direction. A spring brake has a coiled portion wrapped around a portion of the photoconductive drum at an axial end of the photoconductive drum and around the rotational axis of the photoconductive drum. The spring brake has a first armn and a second artn. The first arm is positioned to flex in an unwinding direction of the first arm causing the coiled portion to unwind upon the first arm receiving a force in the first rotational direction. The first arm is positioned to flex in a winding direction of the first arm and to push the second arm in an unwinding direction of the second arm relieving winding of the coiled portion caused by the flexing of the first arm in the winding direction of the first arm upon the first arm receiving a force in the second rotational direction.

A photoconductive drum assembly for use in an electrophotographic image forming device according to another example embodiment includes a photoconductive drum rotatable about a rotational axis in an operative rotational direction and a direction counter to the operative rotational direction. A spring brake has a coiled portion wrapped around a portion of the photoconductive drum at an axial end of the photoconductive drum and around the rotational axis of the photoconductive drum. The spring brake has a first arm and a second arr. The first arm is positioned to flex in a direction that unwinds the coiled portion upon the first arm contacting a first stop when the photoconductive drum rotates in the operative rotational direction. The first arm is positioned to flex in a direction that winds the coiled portion and to push the second arm in a direction that unwinds the coiled portion relieving winding of the coiled portion caused by the flexing of the first arm in the direction that winds the coiled portion upon the first arm contacting a second stop when the photoconductive drum rotates in the direction counter to the operative rotational direction.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 3:
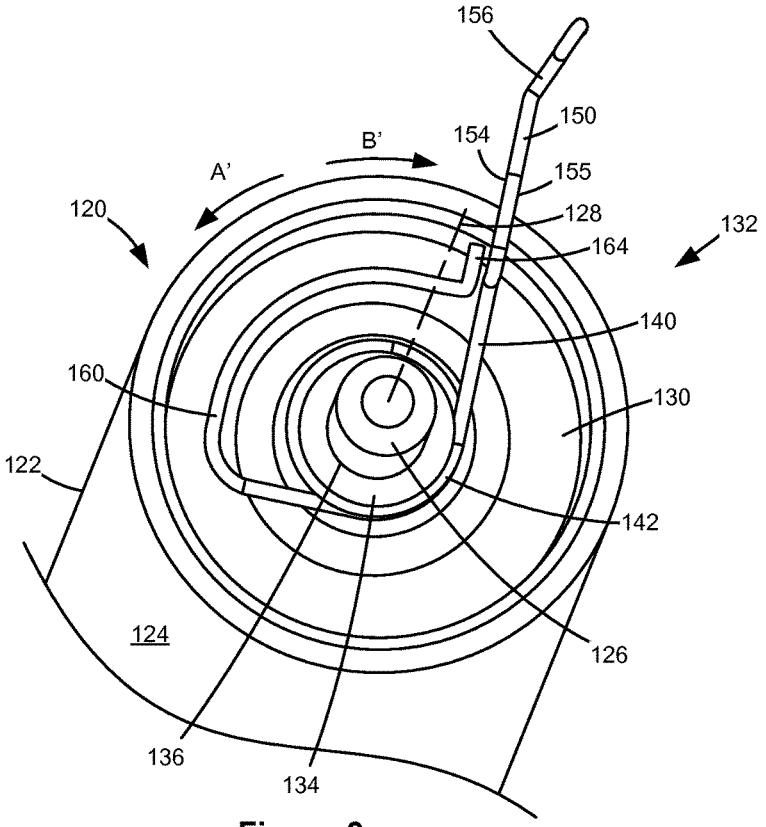
FIG. 3 is a perspective view of a photoconductive drum having a spring brake according to one example embodiment.

FIG. 3 shows a photoconductive drum 120 for use in an electrophotographic image forming device according to one example embodiment. Photoconductive drum 120 includes a hollow cylindrical drum member 122 having an outer surface 124. Drum member 122 is mounted on a shaft 126 that defines a rotational axis 128 of photoconductive drum 120. An end cap 130 is positioned on an axial end 132 of drum member 122. End cap 130 includes a circular hub 134 on an outboard side of end cap 130. Hub 134 has an opening 136 that is centered around rotational axis 128. Shaft 126 is attached to end cap 130 and passes through opening 136 such that shaft 126, end cap 130 and drum member 122 rotate in unison. Photoconductive drum 120 is rotatable in a forward operative rotational direction indicated by arrow A' in FIG. 3 and a reverse direction counter to the operative rotational direction indicated by arrow B' in FIG. 3.

Figure 4:
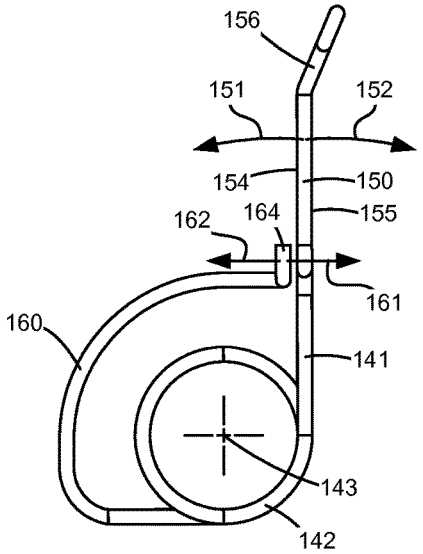
FIG. 4 is a perspective view of the spring brake shown in FIG. 3.

With reference to FIGS. 3 and 4, a spring brake 140 is mounted on axial end 132 of photoconductive drum 120. Spring brake 140 includes a segment of spring wire 141 that forms a coiled portion 142 and a pair of arms 150, 160. Coiled portion 142 includes a middle portion of spring wire 141 coiled around a center axis 143. Arms 150, 160 may be formed by respective ends of spring wire 141. Each arm 150, 160 includes a winding direction 151, 161 around center axis 143 and an unwinding direction 152, 162 around center axis 143. A force on arm 150 in winding direction 151 causes coiled portion 142 to wind tighter and a force on arm 150 in unwinding direction 152 causes coiled portion 142 to unwind. Similarly, a force on arm 160 in winding direction 161 causes coiled portion 142 to wind tighter and a force on arm 160 in unwinding direction 162 causes coiled portion 142 to unwind.

In the embodiment illustrated, coiled portion 142 is wrapped around hub 134 of end cap 130. In other embodiments, coiled portion 142 is wrapped around shaft 126. In the embodiment illustrated, arm 150 extends beyond an outer circumference of end cap 130. Arm 150 includes a front side 154 and a rear side 155. Front side 154 leads in the operative rotational direction of photoconductive drum 120 and rear side 155 trails. A portion of front side 154 of arm 150 is positioned to contact a forward stop when photoconductive drum 120 rotates in the operative rotational direction and a portion of rear side 155 of arm 150 is positioned to contact a rearward stop when photoconductive drum 120 rotates counter to the operative rotational direction as discussed in greater detail below. In the example embodiment illustrated, arm 150 includes a tab 156 positioned beyond the outer circumference of end cap 130. In this embodiment, the front side 154 of tab 156 contacts the forward stop when photoconductive drum 120 rotates in the operative rotational direction and the rear side 155 of tab 156 contacts the rearward stop when photoconductive drum 120 rotates counter to the operative rotational direction.

FIGS. 3 and 4 show arms 150, 160 in their home positions without any external forces, such as from the forward stop or the rearward stop, on arm 150 or arm 160. In the embodiment illustrated, when arms 150, 160 are in their home positions, a portion of arm 160 is positioned in close proximity to front side 154 of arm 150. In some embodiments, a portion of arm 160 rests against front side 154 of arm 150. In other embodiments, a portion of arm 160 is spaced by a few millimeters (e.g., from less than 1 mm up to about 6 mm) ahead of front side 154 of arm 150 with respect to the operative rotational direction of photoconductive drum 120. In the example embodiment illustrated, arm 160 includes a tab 164 positioned in close proximity to front side 154 of arm 150. Arm 160 and tab 164 may be contained within the outer circumference of end cap 130 as illustrated or a portion of arm 160 including tab 164 may extend beyond the outer circumference of end cap 130.

Figure 5:
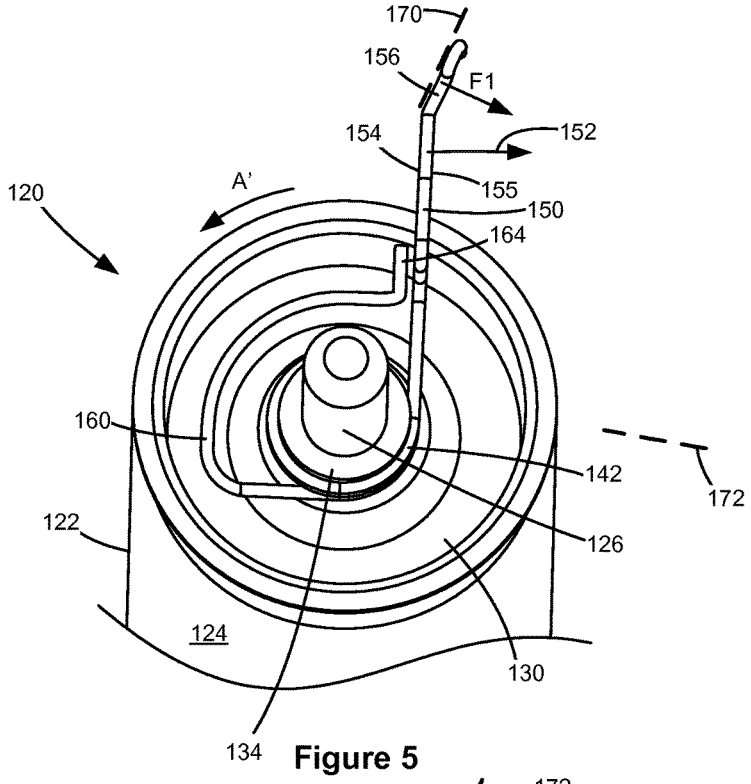
FIG. 5 is a perspective view showing an arm of the spring brake in contact with a forward stop when the photoconductive drum rotates in an operative rotational direction according to one example embodiment.

With reference to FIG. 5, when photoconductive drum 120 rotates in the operative rotational direction indicated by arrow A' in FIG. 5, spring brake 140 rotates with end cap 130 until front side 154 of arm 150 contacts a forward stop 170 (shown schematically), which stops the rotation of spring brake 140 with photoconductive drum 120. When front side 154 of arm 150 contacts forward stop 170, the force F1 on arm 150 from forward stop 170 counter to the operative rotational direction of photoconductive drum 120 causes arm 150 to flex in unwinding direction 152 which, in turn, causes coiled portion 142 to unwind slightly from hub 134. Coiled portion 142 remains in contact with hub 134 but allows photoconductive drum 120 to continue rotating in the operative rotational direction of photoconductive drum 120 with coiled portion 142 applying a uniform drag on photoconductive drum 120.

Figure 6:
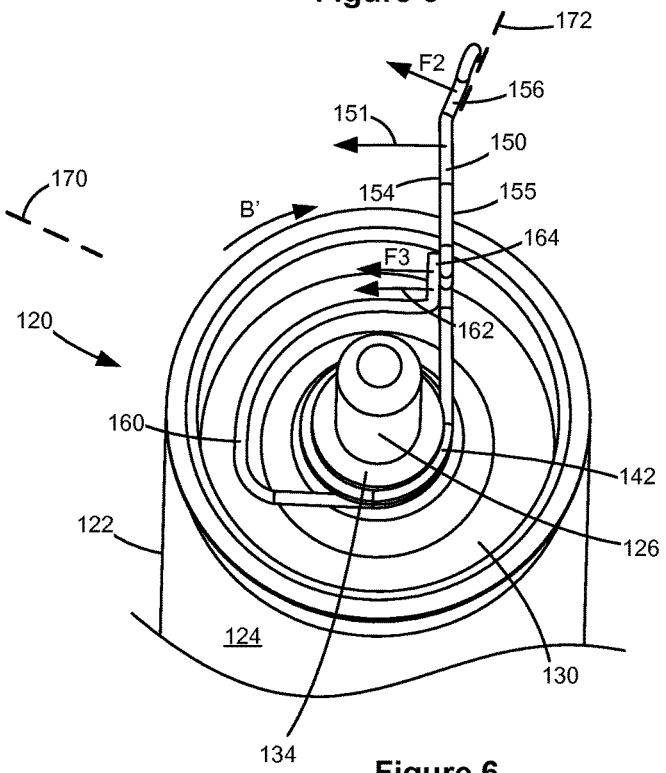
FIG. 6 is a perspective view showing the arm of the spring brake in contact with a rearward stop when the photoconductive drum rotates counter to the operative rotational direction according to one example embodiment.

With reference to FIG. 6, when photoconductive drum 120 rotates counter to the operative rotational direction indicated by arrow B' in FIG. 6, spring brake 140 rotates with end cap 130 until rear side 155 of arm 150 contacts a rearward stop 172 (shown schematically), which stops the rotation of spring brake 140 with photoconductive drum 120. When rear side 155 of arm 150 contacts rearward stop 172, the force F2 on arm 150 from rearward stop 172 in the operative rotational direction of photoconductive drum 120 causes arm 150 to flex in winding direction 151. The flexing of arm 150 in winding direction 151 causes front side 154 of arm 150 to push arm 160 in unwinding direction 162. The force F3 from arm 150 on arm 160 in unwinding direction 162 relieves any tightening of coiled portion 142 around hub 134 that would otherwise result from the flexing of arm 150 in winding direction 151. As a result, coiled portion 142 remains in contact with hub 134 but allows photoconductive drum 120 to continue rotating counter to the operative rotational direction of photoconductive drum 120 with coiled portion 142 applying a uniform drag on photoconductive drum 120.

In some embodiments, forward stop 170 and rearward stop 172 are positioned on the housing of a replaceable unit that holds photoconductive drum 120. In other embodiments, forward stop 170 and rearward stop 172 are positioned on the frame of the electrophotographic image forming device or on another replaceable unit of the image forming device.

Spring brake 140 allows rotation of photoconductive drum 120 in both the forward operative direction and the reverse direction counter to the operative direction. It may be desirable to periodically rotate photoconductive drum 120 counter to its operative rotational direction in order to dislodge toner fragments that tend to accumulate on a cleaning blade that is positioned against outer surface 124 of photoconductive drum 120 and that removes residual toner from outer surface 124. Photoconductive drum 120 may also be rotated counter to its operative rotational direction in order to introduce slack into a gear train that drives photoconductive drum 120 in order to make it easier for a user to remove a replaceable unit that holds photoconductive drum 120 from the image forming device.

Figure 1:
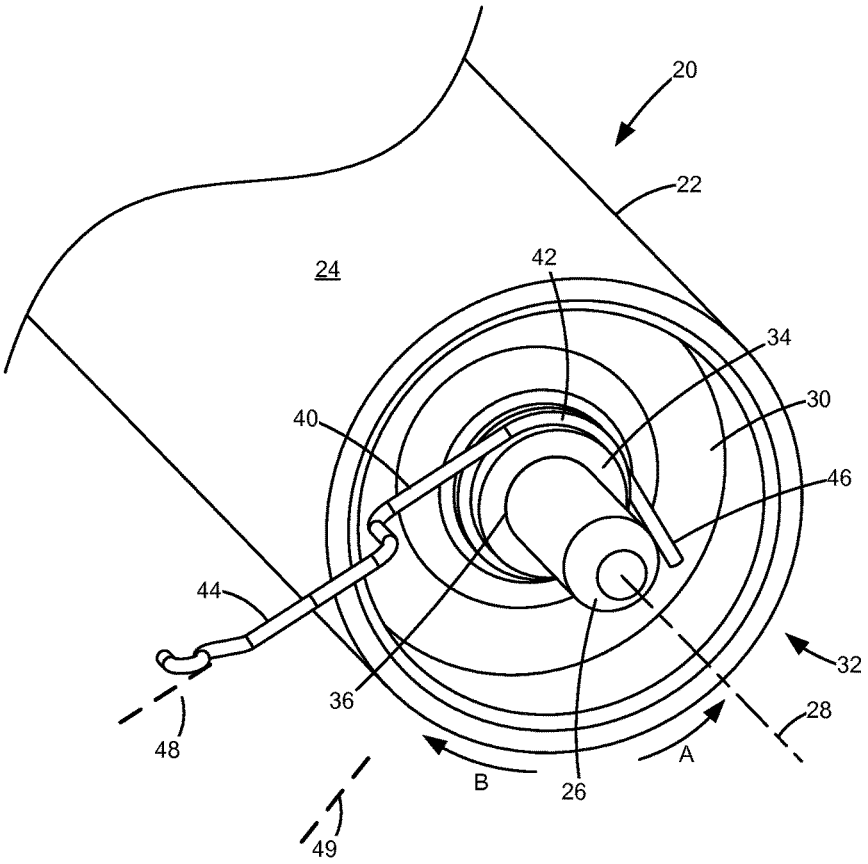
Figure 1 Prior Art
FIG. 1 is a perspective view of a prior art photoconductive drum having a spring brake.
Figure 2:
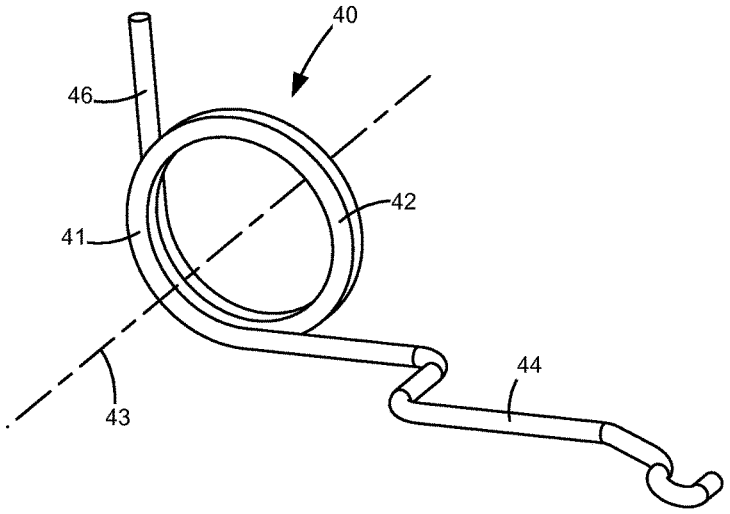
Figure 2 Prior Art
FIG. 2 is a perspective view of the spring brake shown in FIG. 1.

In contrast, if photoconductive drum 20 shown in FIG. 1 is driven counter to its operative rotational direction as indicated by arrow B in FIG. 1 far enough for arm 44 of spring brake 40 to contact a rear side 49 (shown schematically) of stop 48, the force on arm 44 from stop 48 causes arm 44 to flex in the operative rotational direction of photoconductive drum 20 which, in turn, causes coiled portion 42 to tighten around hub 34. Damage may result if photoconductive drum 20 continues to be driven counter to its operative rotational direction against the tightening of coiled portion 42 around hub 34. For example, arm 44 of spring brake 40 may tend to bend against stop 48 to the point of permanently deforming spring brake 40. Continued rotation of photoconductive drum 20 counter to its operative rotational direction may also damage end cap 30 of photoconductive drum 20 or a gear train or motor driving photoconductive drum 20. The positioning of arm 160 of spring brake 140 in close proximity to front side 154 of arm 150 prevents coiled portion 142 of spring brake 140 from excessively tightening around hub 134. The flexing of arm 150 against arm 160 in unwinding direction 162 of arm 160 relieves tightening of coiled portion 142 around hub 134 permitting photoconductive drum 120 to continue rotating counter to its operative rotational direction.

Figure 7:
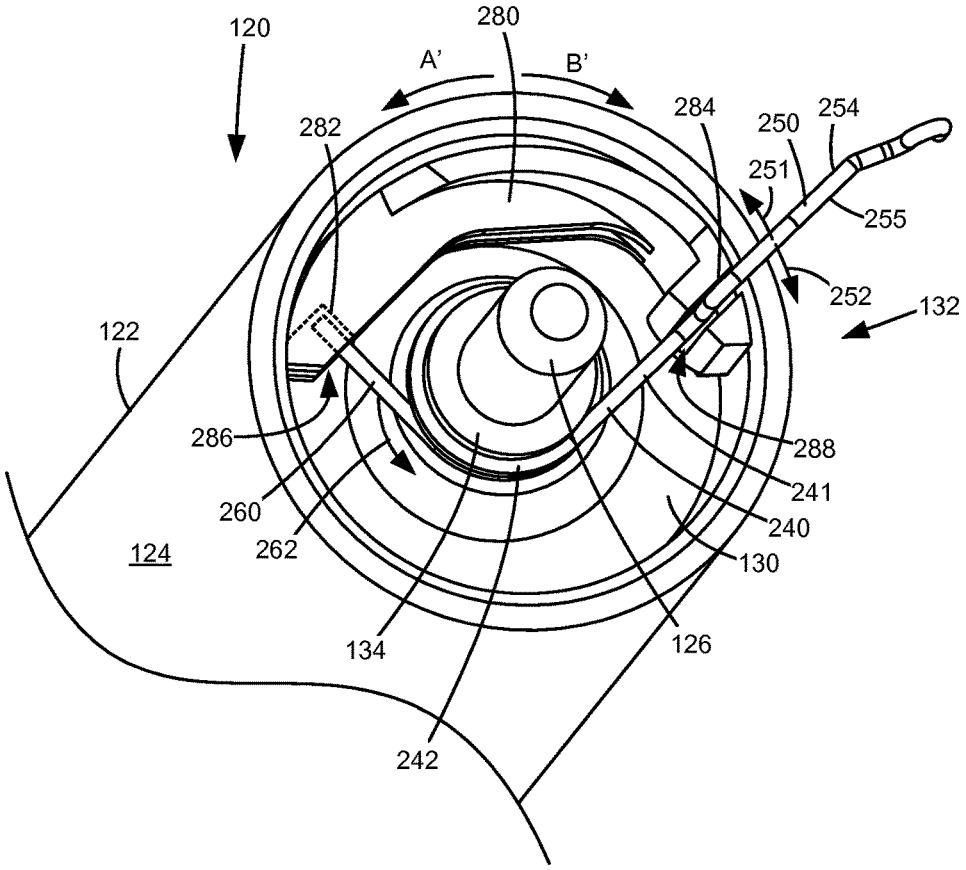
FIG. 7 is a perspective view of the photoconductive drum having a spring brake according to another example embodiment.

FIG. 7 shows a photoconductive drum 120 according to another example embodiment that includes a spring brake 240 that allows rotation of photoconductive drum 120 in both an operative forward direction and a reverse direction. Spring brake 240 includes a segment of spring wire 241 that forms a coiled portion 242 and a pair of arms 250, 260 like spring brake 140 discussed above. Spring brake 240 also includes an intermediate member 280 positioned on end cap 130. Intermediate member 280 includes a front end wall 282 positioned behind and in close proximity to arm 260 with respect to the operative rotational direction of photoconductive drum 120 and a rear end wall 284 positioned in front of and in close proximity to arm 250 with respect to the operative rotational direction of photoconductive drum 120. In the example embodiment illustrated, front end wall 282 is formed in a front slot 286 in intermediate member 280 that receives arm 260 and rear end wall 284 is formed in a rear slot 288 in intermediate member 280 that receives arm 250.

When photoconductive drum 120 rotates in the operative rotational direction indicated by arrow A' in FIG. 7, spring brake 240 rotates with end cap 130 until a front side 254 of arm 250 contacts forward stop 170 as discussed above. When front side 254 of arm 250 contacts forward stop 170, the force on arm 250 from forward stop 170 counter to the operative rotational direction of photoconductive drum 120 causes arm 250 to flex in an unwinding direction 252 of arm 250 which, in turn, causes coiled portion 242 to unwind slightly from hub 134. Rear slot 288 provides sufficient clearance to allow arm 250 to flex in unwinding direction 252. When photoconductive drum 120 rotates counter to the operative rotational direction indicated by arrow B' in FIG. 7, spring brake 240 rotates with end cap 130 until a rear side 255 of arm 250 contacts rearward stop 172 as discussed above. When rear side 255 of arm 250 contacts rearward stop 172, the force on arm 250 from rearward stop 172 in the operative rotational direction of photoconductive drum 120 causes arm 250 to flex in a winding direction 251 of arm 250. The flexing of arm 250 in winding direction 251 causes front side 254 of arm 250 to push against rear end wall 284 of intermediate member 280 in the operative rotational direction of photoconductive drum 120 which, in turn, causes front end wall 282 of intermediate member 280 to push against arm 260 in an unwinding direction 262 of arm 260. The force on arm 260 from front end wall 282 of intermediate member 280 in unwinding direction 262 relieves any tightening of coiled portion 242 around hub 134 that would otherwise result from the flexing of arm 250 in winding direction 251. In this manner, intermediate member 280 allows photoconductive drum 120 to rotate counter to its operative rotational direction without damaging spring brake 240.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A spring brake for use with a photoconductive drum of an electrophotographic image forming device, comprising:

a spring wire having a coiled portion and first and second arms extending from the coiled portion, the coiled portion is coiled around a center axis, each of the first arm and the second arm has a winding direction around the center axis and an unwinding direction around the center axis, a force on the first arm in the winding direction of the first arm causes the coiled portion to wind and a force on the first arm in the unwinding direction of the first arm causes the coiled portion to unwind, a force on the second arm in the winding direction of the second arm causes the coiled portion to wind and a force on the second arm in the unwinding direction of the second arm causes the coiled portion to unwind, wherein in home positions of the first arm and the second arm, a portion of the second arm is positioned in close proximity to the first arm such that flexing of the first arm from the home position of the first arm in the winding direction of the first arm causes the first arm to push the second arm from the home position of the second arm in the unwinding direction of the second arm relieving winding of the coiled portion caused by the flexing of the first arm in the winding direction of the first arm.

2. The spring brake of claim 1, wherein in home positions of the first arm and the second arm, the portion of the second arm is in contact with the first arm such that flexing of the first arm from the home position of the first arm in the winding direction of the first arm causes the first arm to push on the portion of the second arm in contact with the first arm.

3. The spring brake of claim 1, wherein in home positions of the first arm and the second arm, the portion of the second arm is closely spaced from the first arm such that flexing of the first arm from the home position of the first arm in the winding direction of the first arm causes the first arm to contact and push on the portion of the second arm.

4. The spring brake of claim 1, wherein the portion of the second arm positioned in close proximity to the first arm includes a tab formed on the second arm positioned in close proximity to the first arm such that flexing of the first arm from the home position of the first arm in the winding direction of the first arm causes the first arm to push on the tab of the second arm.

5. A photoconductive drum assembly for use in an electrophotographic image forming device, comprising:

a photoconductive drum rotatable about a rotational axis in a first rotational direction and a second rotational direction opposite the first rotational direction; and a spring brake having a coiled portion wrapped around a portion of the photoconductive drum at an axial end of the photoconductive drum and around the rotational axis of the photoconductive drum, the spring brake having a first arm and a second arm, the first arm is positioned to flex in an unwinding direction of the first arm causing the coiled portion to unwind upon the first arm receiving a force in the first rotational direction, the first arm is positioned to flex in a winding direction of the first arm and to push the second arm in an unwinding direction of the second arm relieving winding of the coiled portion caused by the flexing of the first arm in the winding direction of the first arm upon the first arm receiving a force in the second rotational direction.

6. The photoconductive drum assembly of claim 5, wherein the first arm is positioned to flex in the winding direction of the first arm and to directly contact and push the second arm in the unwinding direction of the second arm upon the first arm receiving the force in the second rotational direction.

7. The photoconductive drum assembly of claim 5, wherein the first arm is positioned to flex in the winding direction of the first arm and to push at least one intermediate member that, in turn, pushes the second arm in the unwinding direction of the second arm upon the first arm receiving the force in the second rotational direction.

8. The photoconductive drum assembly of claim 5, wherein the photoconductive drum includes an end cap at the axial end of the photoconductive drum, the end cap includes a hub centered around the rotational axis of the photoconductive drum, the coiled portion of the spring brake is wrapped around the hub.

9. A photoconductive drum assembly for use in an electrophotographic image forming device, comprising:

a photoconductive drum rotatable about a rotational axis in an operative rotational direction and a direction counter to the operative rotational direction; and a spring brake having a coiled portion wrapped around a portion of the photoconductive drum at an axial end of the photoconductive drum and around the rotational axis of the photoconductive drum, the spring brake having a first arm and a second arm, the first arm is positioned to flex in a direction that unwinds the coiled portion upon the first arm contacting a first stop when the photoconductive drum rotates in the operative rotational direction, the first arm is positioned to flex in a direction that winds the coiled portion and to push the second arm in a direction that unwinds the coiled portion relieving winding of the coiled portion caused by the flexing of the first arm in the direction that winds the coiled portion upon the first arm contacting a second stop when the photoconductive drum rotates in the direction counter to the operative rotational direction.

10. The photoconductive drum assembly of claim 9, wherein the first arm is positioned to flex in the direction that winds the coiled portion and to directly contact and push the second arm in the direction that unwinds the coiled portion upon the first arm contacting the second stop when the photoconductive drum rotates in the direction counter to the operative rotational direction.

11. The photoconductive drum assembly of claim 9, wherein the first arm is positioned to flex in the direction that winds the coiled portion and to push at least one intermediate member that, in turn, pushes the second arm in the direction that unwinds the coiled portion upon the first arm contacting the second stop when the photoconductive drum rotates in the direction counter to the operative rotational direction.

12. The photoconductive drum assembly of claim 9, wherein the photoconductive drum includes an end cap at the axial end of the photoconductive drum, the end cap includes a hub centered around the rotational axis of the photoconductive drum, the coiled portion of the spring brake is wrapped around the hub.

* * * * *